US010376023B1

(12) United States Patent
Homme

(10) Patent No.: US 10,376,023 B1
(45) Date of Patent: Aug. 13, 2019

(54) EARRING DEVICE

(71) Applicant: Gretchen Homme, Anoka, MN (US)

(72) Inventor: Gretchen Homme, Anoka, MN (US)

( * ) Notice: Subject to any disclaimer, the term of this patent is extended or adjusted under 35 U.S.C. 154(b) by 57 days.

(21) Appl. No.: 15/416,284

(22) Filed: Jan. 26, 2017

Related U.S. Application Data

(60) Provisional application No. 62/388,667, filed on Feb. 4, 2016.

(51) Int. Cl.
*A44C 7/00* (2006.01)
*A44C 15/00* (2006.01)

(52) U.S. Cl.
CPC ..... *A44C 7/006* (2013.01)

(58) Field of Classification Search
CPC ..... A44C 7/00; A44C 7/002; A44C 7/004; A44C 7/006; A44C 7/007; A44C 15/00; A44C 25/00
USPC ..... 63/14.1, 14.4, 14.5, 14.6, 14.9, 14.7, 40, 63/33, 35
See application file for complete search history.

(56) References Cited

U.S. PATENT DOCUMENTS 2,936,600 A * 5/1960 Crigler ..... A44C 7/00 63/14.1
5,513,502 A * 5/1996 Seaton, Jr. ..... A44C 7/006 63/14.4
2005/0044888 A1* 3/2005 Tian ..... A44C 7/006 63/14.1

* cited by examiner

*Primary Examiner* — Jack W Lavinder
(74) *Attorney, Agent, or Firm* — Matthew M. Googe; Robinson IP Law, PLLC

(57) ABSTRACT

An earring device is provided for supporting earrings on a wearer's ears. The earring device includes: a plate including an aperture formed therethrough; a pair of legs extending substantially perpendicular to the plate from a lower end of the plate; an upright member on each of the pair of legs, the upright member positioned at an end of each of the pair of legs that is distal from the plate; and a closure mechanism pivotally attached between the at least one of the upright members on the pair of legs.

4 Claims, 4 Drawing Sheets

EARRING DEVICE

CROSS-REFERENCE TO RELATED APPLICATION

This application claims priority to U.S. Provisional Patent Application No. 62/388,667 for an Earring Device to Gretchen Homme and filed on Feb. 4, 2016, the contents of which are incorporated herein by reference in its entirety.

FIELD

This disclosure relates to the field of jewelry. More particularly, this disclosure relates to an earring device for supporting earrings on a wearer's earlobes.

BACKGROUND

It is estimated that 83% of Americans have or have had ear piercings during their lifetimes. Holes created from ear piercings typically sag or tear over time as a wearer ages. Further, a person's earlobes may become torn if an earring is accidentally pulled while a person is wearing earrings. If an earlobe is damaged, the cost to repair a damaged earlobe is typically at least between $400 and $500.

What is needed, therefore, is an earring device for supporting an earring from a wearer's ear even if the wearer has damaged earlobes. What is also needed is a safe and comfortable alternative for people to wear earrings that do not have pierced ears or who experience discomfort from traditional clips or screws supporting earrings.

SUMMARY

The above and other needs are met by an apparatus for supporting earrings on a wearer's ears. In a first aspect, an earring device for supporting one or more earrings on a wearer's ear is provided, the earring device including a plate including an aperture formed therethrough, a pair of legs extending substantially perpendicular to the plate from a lower end of the plate, an upright member on each of the pair of legs, the upright member positioned at an end of each of the pair of legs that is distal from the plate, and a closure mechanism pivotally attached between at least one of the upright members on the pair of legs.

In one embodiment, the upright member is formed of an elongate member extending between distal ends of each of the pair of legs.

In another embodiment, the earring device further includes a piece of adhesive tape sized to conform to a backside of a wearer's earlobe, wherein the plate is attached to the adhesive tape.

In yet another embodiment, the closure mechanism is substantially U-shaped and pivotally attached to the upright members of each of the pair of legs.

In a second aspect, an earring device for supporting one or more earrings on a wearer's ear is provided, the earring device including: a plate including an aperture formed therethrough; a pair of legs extending substantially perpendicular to the plate from a lower end of the plate; an upright member on each of the pair of legs, the upright member positioned at an end of each of the pair of legs that is distal from the plate; and a closure mechanism pivotally attached between the at least one of the upright members on the pair of legs.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

An earring device 10 (FIGS. 8 and 9) for supporting one or more earrings to be worn on a wearer's unpierced, pierced, or damaged ears. The earring device is shaped to conform to a backside of a wearer's ear at the earlobe to support at least one earring on the wearer's ear. The earring device supports one or more earrings on the wearer's ears to prevent damage (on a non-pierced ear) and to reduce further damage to a ripped or torn earlobe.

Figure 1:
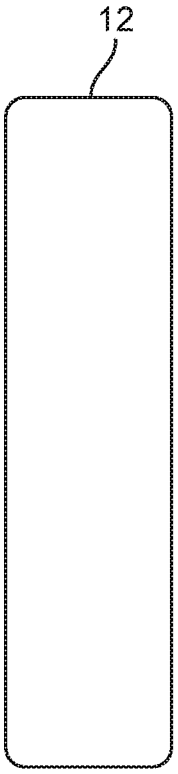
FIG. 1 shows an adhesive strip of an earring device according to one embodiment of the present disclosure.

Referring to FIG. 1, the earring device 10 includes a strip of adhesive tape 12 or other adhesive strip that is shaped to adhere to the back of a wearer's ear at the earlobe. The adhesive tape strip 12 includes an adhesive side and an opposing non-adhesive side. The adhesive tape strip 12 has a length of approximately 1.5 inches.

Figure 2:
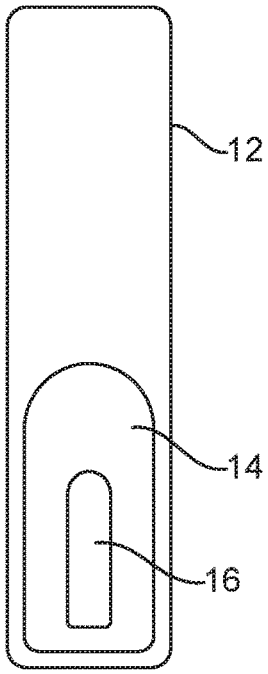
FIG. 2 shows an adhesive strip and plate of an earring device according to one embodiment of the present disclosure.

A plate 14 is attached to the non-adhesive side of the medical tape strip 12, as shown in FIG. 2. The plate 14 is attached to the adhesive strip (such as medical tape) using an adhesive such as an epoxy or other adhesive. Alternatively, the plate 14 may be mechanically attached to the medical tape strip 12 or the plate 14 and medical tape strip 12 may be formed as a single piece. The plate 14 includes an aperture 16 formed through a center of the plate. The aperture 16 is preferably elongate in shape and aligned with a center of the medical tape strip 12.

Figure 3:
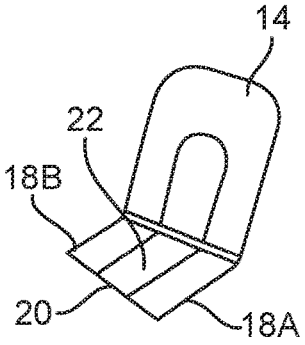
FIG. 3 shows a plate of an earring device according to one embodiment of the present disclosure.

Referring now to FIG. 3, the plate 14 includes a pair of legs 18A and 18B extending from a lower end of the plate 14. The pair of legs 18A and 18B extend substantially perpendicular from a lower end of the plate 14. An optional bar 20 may extend between ends of the pair of legs 18A and 18B, thereby creating a second aperture 22 that is substantially perpendicular to a plane of the plate 14 and medical tape strip 12.

Figure 4:
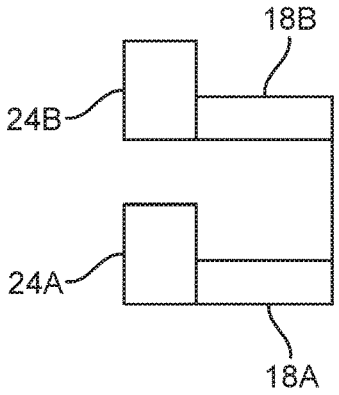
FIGS. 4-10 illustrate an earring device according to embodiments of the present disclosure.
Figure 5:
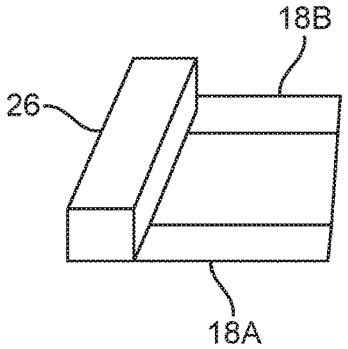
Figure 6:
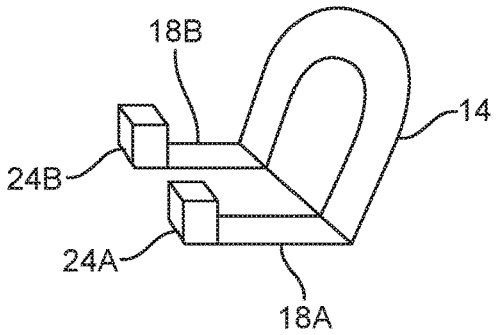

Each of the pair of legs 18A and 18B may include upright members 24A and 24B (FIG. 6) formed on ends of the pair of legs 18A and 18B that are distal from the plate 14. The upright members 24A and 24B may include individual upright portions on ends of each of the legs 18A and 18B, as illustrated in FIG. 4. Alternatively, the upright members 24A and 24B may be formed of a single elongate piece 26 connecting ends of the pair of legs 18A and 18B, as shown in FIG. 5.

The legs 18A and 18B may have a cross-sectional area that is substantially rectangular or square, as shown in FIGS.

4-6. However, it is also understood that the upright members 24A and 24B may be formed into other various shapes, such as a shape having a circular cross-sectional area.

Figure 7:
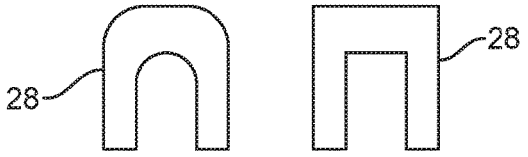
Figure 8:
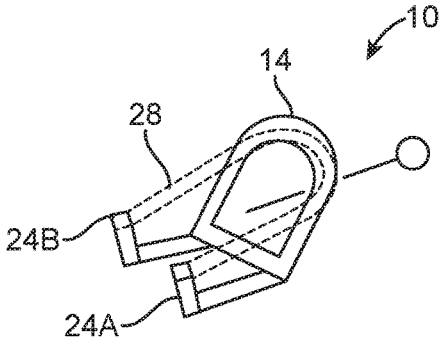

A closure mechanism 28 (FIG. 7) is positioned between ends of the pair of legs 18A and 18B and an upper portion of the plate 14 above the aperture 16 to maintain an earring on the earring device 10. The closure mechanism 28 is hingedly attached to upper ends of the upright members 24A and 24B such that the closure mechanism pivots between a first closed position shown in FIG. 7 and a second open position shown in FIG. 8 for receiving one or more earrings as described in greater detail below. The closure mechanism 28 is preferably hingedly attached with a spring hinge such that the closure mechanism 28 is maintained against the plate 14 as shown in FIG. 8. Alternatively, the closure mechanism 28 may be secured to the upright members 24A and 24B without a spring and instead include a clasp or closure mechanism for securing the closure mechanism 28 against the plate 14.

Figure 10:
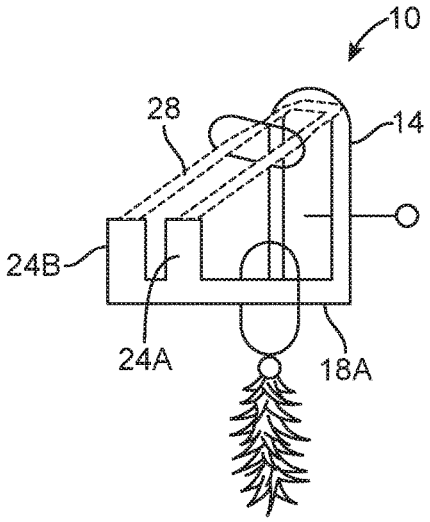

In operation, a wearer secures the earring device 10 to the back of the wearer's ear on the earlobe. The earring device 10 is adhered to the back of the wearer's ear using the adhesive strip. The wearer may then insert a post or fish-hook style earring through the wearer's earlobe (FIG. 10). An end of the post or fish-hook style earring extends through the wearer's earlobe and through the aperture 16 of the earring device 10. The plate 14 of the earring device 10 supports the earring and prevents the earring from sliding down a wearer's earlobe or otherwise splitting the earlobe.

Figure 9:
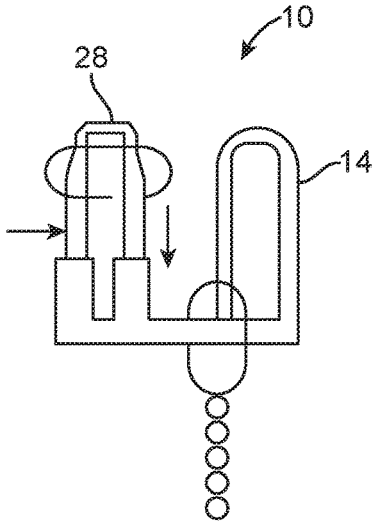

A wearer may also add one or more loop or other types of earrings over the legs 18A and 18B to support one or more earrings behind the wearer's ear, as shown in FIGS. 8 and 9. The closure mechanism 28 is pivoted to an open position. The wearer then slides a loop of the earring over the closure mechanism 28, upright members 24A and 24B, and onto the legs 18A and 18B.

The earring device 10 of the present disclosure advantageously allows multiple earrings to be worn by a wearer both in front of the wearer's ear and behind the ear. Further, the earring device 10 supports the earrings such that the earrings do not slide down the wearer's earlobe and further allows a wearer with split earlobes to wear earrings.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An earring device for supporting one or more earrings on a wearer's ear, the earring device comprising:

a plate including an aperture formed therethrough;

a pair of legs extending substantially perpendicular to the plate from a lower end of the plate;

an upright member positioned at an end of each of the pair of legs that is distal from the plate, wherein the upright member is formed of an elongate member extending between distal ends of each of the pair of legs; and a closure mechanism pivotally attached to the upright member on the pair of legs.

2. The earring device of claim 1, further comprising a piece of adhesive tape sized to conform to a backside of a wearer's earlobe, wherein the plate is attached to the adhesive tape.

3. The earring device of claim 1, wherein the closure mechanism is substantially U-shaped and pivotally attached to the upright members of each of the pair of legs.

4. An earring device for supporting one or more earrings on a wearer's ear, the earring device comprising:

a plate including an aperture formed therethrough;

a pair of legs extending substantially perpendicular to the plate from a lower end of the plate;

an upright member positioned at an end of each of the pair of legs that is distal from the plate, wherein the upright member is formed of an elongate member extending between distal ends of each of the pair of legs; and a U-shaped closure mechanism pivotally attached to the upright member on the pair of legs.

* * * * *